United States Patent [19]

Fukayama et al.

[11] Patent Number: 4,841,918

[45] Date of Patent: Jun. 27, 1989

[54] BOILER CONTROL SYSTEM

[75] Inventors: Yukio Fukayama, Kure; Atsushi Kuramoto, Fukuoka, both of Japan

[73] Assignee: Babcock-Hitachi Kabushiki Kaisha, Tokyo, Japan

[21] Appl. No.: 116,582

[22] Filed: Nov. 4, 1987

[30] Foreign Application Priority Data

Nov. 6, 1986 [JP] Japan ..... 61-262781

[51] Int. Cl.[4] ..... F22D 7/00

[52] U.S. Cl. ..... 122/406 ST; 122/448 R; 122/451.2; 122/452

[58] Field of Search ..... 122/446, 448 R, 448 A, 122/448 S, 406 ST, 451 R, 451 S, 451.1, 451.2; 236/14, 15 C; 364/477, 166

[56] References Cited

U.S. PATENT DOCUMENTS

| | | | |
|---|---|---|---|
| 3,532,079 | 10/1970 | Chambert | 122/406 ST |
| 3,828,737 | 8/1974 | Fujii et al. | 127/448 S X |
| 4,262,636 | 4/1981 | Augsburger | 122/406 ST |
| 4,637,348 | 1/1987 | Fukayama | 122/406 ST |

*Primary Examiner*—Steven E. Warner

*Attorney, Agent, or Firm*—Antonelli, Terry, Wands

[57] ABSTRACT

A boiler control system includes a first device for measuring or computing a rate of change in steam temperature and a generated thermal stress in a pressure part of a boiler, and a second device for controlling steam temperature or a rate of change in the steam temperature at the pressure part of the boiler in accordance with a desired value, and a third device which has functions for storing in a memory combinations of the steam temperature and the thermal stress at each moment as obtained by the first device. The third device determining, from the combinations stored in the memory, a relationship between a steam temperature changing rate and a maximum thermal stress caused by the steam temperature changing rate, determines, in accordance with the relationship, a steam temperature changing rate limit value necessary for maintaining an actual thermal stress in the pressure part of the boiler below a maximum thermal stress limit value which is predetermined beforehand or which is given for each start-up of the boiler, and delivers the steam temperature changing rate limit value or desired steam temperature value obtained by integrating the steam temperature changing rate limit value to the second device as the desired value.

3 Claims, 6 Drawing Sheets

BOILER CONTROL SYSTEM

FIELD OF THE INVENTION AND RELATED ART STATEMENT

The present invention relates to a boiler control system for use in a plant having a boiler and, more particularly, to a boiler control system which can control the operation of the plant while managing the longevity of the life of pressure parts of the boiler.

In a plant having a boiler, as is well known to those skilled in the art, the level of thermal stress occurring in a boiler depends on the temperature difference across the metallic material constituting the vessel of a tube in the boiler. More specifically, the greater the thickness of the metallic material increases and the greater the rate of temperature change of the internal fluid becomes, the higher the level of the thermal stress increases. Obviously, the higher level of the thermal stress produces serious influence on the apparatus from the view point of life consumption or longevity. It is known that the portions of a boiler system which undergoes the most severe conditions are the heater on the outlet side of a superheater and the steam-water separator (or a drum). It has been commonly recognized that monitoring of the thermal stress in such portions of boiler systems is significant, and various methods have been developed for measuring such thermal stress.

Among these proposed thermal stress measuring methods, a method which makes use of a strain gauge adhered to the object is recommended for obtaining a higher measuring accuracy. This method, however, is not suitable for use in a stress monitoring system which is to be permanentally installed in the boiler system. A suitable thermal stress monitoring method has been proposed for such a purpose in "BOILER THERMAL STRESS MONITORING SYSTEM" by MIYAGAKI and HODOZUKA, HITACHI HYORON VOL. 65, NO. 6, p. 391, JUNE 1983, in which the thermal stress is arithmetically computed from measured values of temperature and pressure of the internal fluid. This monitoring system is superior both in durability and ease of handling, and has been used practically and widely.

Further, a main steam temperature predictive adaptive control has been proposed for controlling the boiler using the monitored data of the thermal stress. This method also is disclosed in "BOILER THERMAL STRESS MONITORING SYSTEM." According to this method, a future main steam set temperature is determined in accordance with a predicted future thermal stress value, and a rate of supply of the fuel is corrected in accordance with the offset between the future main steam set temperature and a predicted future steam temperature. The prediction of the future main steam temperature employed in this adaptive control basically relies upon a physical model and is disclosed in "BOILER STEAM TEMPERATURE PREDICTIVE CONTROL UTILIZING KALMAN FILTER" by UJII et al, KEISOU, Special Issue p. 113, 1983.

The above-described prior system suffers from the following major problems.

(1) Setting of the optimum temperature and pressure rise pattern is rather difficult. The term "optimum pattern" is used to generally mean the pattern of temperature or pressure rise which enables the temperature or the pressure of the steam to rise in the shortest period while suppressing thermal stress occurring in the thick-walled portion of the boiler. As stated before, the most critical thick-walled portions in the boiler from the view point of thermal stress control are the outlet header of the superheater and the steam-water separator (or the drum). Thus, the optimum pattern of the temperature rise is the pattern which maintains a momentary rate of rise of the steam temperature (referred to as "temperature rising rate" hereinafter) in the outlet of the superheater at an uppermost level approximating but below a limit value by which the thermal stress occurring therein is restricted to a predetermined allowable thermal stress level. Similarly, the optimum pattern of the pressure rise is the pattern which maintains a momentary rate of rise of the steam pressure (referred to as "pressure rising rate" hereinunder) at an uppermost level approximating but below a limit value by which thermal stress occurring therein is restricted to a predetermined allowable thermal stress level. The temperature rising rate affects the thermal stress of the outlet header of the superheater. The pressure rising rate affects the saturated steam temperature change and then affects the thermal stress of the steam-water separator (or the drum).

In the prior system explained above, the temperature rising rate and the pressure rising rate are controlled in accordance with values set in and output from function generators. For obtaining optimum temperature and pressure rising rates, it is necessary to conduct repeated experiments by operating actual boilers. In addition, if the level of the initial steam pressure, i.e., the steam pressure at the moment at which the burner is fired is different from that at the function generator setting, the actual temperature and pressure rising rates are undesirably deviated from the scheduled rates of rise of the steam temperature and pressure. In order to obviate this problem, the values set in the function generators have been selected such that the temperature rising rate and the pressure rising rate do not exceed the limit values at every moment in the course of the rise of the temperature and pressure, regardless of the initial steam pressure. In consequence, the patterns of the temperature and pressure rise obtained under such control by the function generators largely deviate from the optimum temperature and pressure rising patterns. The start-up period becomes considerably longer than the start-up period which would be obtained if the temperature and the pressure were made to rise in the optimum patterns.

(2) The conventional system does not offer easy management of the life of the plant. It may be possible that, as explained before, the known system employs a thermal stress monitoring method which provides data concerning the thermal stress occurring in thick-walled portion during start-up of the plant. After completion of one heating or operation cycle from the start-up to the stop of the plant, the life consumption in this operation cycle can be computed from the data derived from the monitoring system concerning the magnitude and the duration of the thermal stress.

It is to be understood, however, the ultimate purpose of the life consumption management of the plant is to enable the user to flexibly adapt the manner of start-up to the situation of the demand. For instance, in some cases such as emergencies, it is required to start-up the plant as quickly as possible even though a considerably large consumption of the plant life is expected. In other cases which are normal, the start-up is conducted in such a way as to minimize the life consumption. It is highly desirable that the management of the plant life consumption is conducted in such a way as to facilitate the selection and execution of the start-up pattern in accordance with the demand.

From this point of view, the known control system is unsatisfactory in that it only informs the operator of the life consumption of the plant because such life consumption per operation cycle is computed only after the completion of each operation cycle. Thus, the conventional system cannot meet the demand for enabling the operator to start-up the plant in conformity with the plan worked out from the view point of the life consumption management.

(3) A system has been proposed which has been improved over the known systems so as to control the fuel supply rate with taking into account the future behavior of the thermal stress. This improved system, however, does not meet the requirement stated in (2) above for high flexibility of selection and execution of start-up patterns in the management of life consumption.

(4) The known systems suffer from a common disadvantage in that they are not designed for reducing the loss of energy at the time of start-up of the boiler. When the boiler is started-up with given temperature and pressure rising rates in the plant having the boiler explained before, the relationships between factors or parameters such as the rate of the fuel to be supplied through the fuel flow-rate control valve, the opening degree of the superheater bypass valve and the opening degree of the turbine bypass valve are variable and not definite. For instance, in some cases, it may be required to extract a large quantity of steam through the superheater bypass valve and the turbine bypass valve while supplying a large quantity of fuel to the burner or, conversely, it may be required to minimize the fuel supply rate while extracting only small quantities of steam through these bypass valves. It will be understood that start-up with minimal energy loss can be obtained when the above-mentioned three factors or parameters are combined in such a way as to minimize the degree of opening of the fuel flow-rate control valve while attaining the required rates of rises of the temperature and the pressure.

Unfortunately, the known systems lack any function which would systematically control these three factors or parameters, i.e., the degree of opening of the superheater bypass valve, the degree of opening of the turbine bypass valve and the degree of opening of the fuel flow-rate control valve. In other words, the known systems require independent control of an opening setting device and function generators for reducing the loss of energy during start-up of the boiler. Practically, however, it is almost impossible to conduct independent control of these three devices in such a manner as to maintain optimum temperature and pressure rising rates while minimizing the energy loss incurred during the start-up of the boiler.

OBJECT AND SUMMARY OF THE INVENTION

An object of the invention is to provide a boiler control system which can not only maintain the optimum rates of rise of the temperature and the pressure in the boiler but minimize the energy boss at the starting-up to the boiler.

To this end, according to the present invention, provided is a boiler control system having means for measuring, calculating or predicting the temperature of the fluid in the pressure parts of the boiler, as well as the value of the thermal stress generated in such pressure parts, and means for controlling the temperature or the rate of change in the temperature of the fluid in the pressure parts, wherein the relationship between the rate of change of the temperature peculiar to the boiler and the local maximum value of the generated thermal stress and the relationship between the local maximum value of the generated thermal stress and the life consumption value after the completion of the instant heat cycle are determined, a fluid temperature changing rate is calculated using these relationships from a life consumption value under a given start-up operation and the rate of change in the fluid temperature is controlled using this changing rate as the command value. It is thus possible to start-up the plant in the best way in such a manner as to shorten the start-up time without allowing thermal stress to exceed an allowable limit, while minimizing energy loss. Obviously, the same effect can be produced by modifying the system in such a manner that the fluid temperature itself is controlled in conformity with a temperature command value which is obtained by integrating the command changing rate of the fluid temperature.

Thus, the critical feature of this invention resides in the determination of the relationship between the fluid temperature changing rate and the local maximum value of the thermal stress, and the determination of the relationship between the local maximum value of the thermal stress and the life consumption per heat cycle. Practically, in connection with the former relationship, there is a large time lag for the thermal stress to reach the maximum level after a change in the fluid temperature. The time lag depends on various factors such as the heat capacity and heat conductivity of the material. In connection with the latter relationship, the life consumption is obtainable only after completion of each heat cycle, because the life consumption cannot be definitely grasped unless the heat hysteresis in each heat cycle is taken into consideration. It is extremely laborious and difficult to represent these two relationships by, for example, simultaneous differential equations in accordance with the physical laws, or physical modeling.

From the view point of practical running of the plant, considering that ordinary plant experiences start-up cycles on the order of 1,000 times throughout its life, these two relationships need not be determined for each start-up cycle but these relationships are required to be determined as mean values throughout numerous start-up cycles with an acceptable level of accuracy. Any error which may be involved in each start-up cycle due to uncertain factors can be neglected because errors in successive cycles are negated as the plant experiences many start-up operations. Thus, from a practical point of view, the above-mentioned relationships are preferably obtained by means of statistic models which employ accumulation of numerous data.

Amongst various statistic model procedures, a method known as the linear regressive model method is recommended because it is simple and effective. This method will be briefly explained hereinunder. For further detail of the statistic model procedures, a reference may be made to "MULTIVARIATE ANALYSIS" by KUNO et al, Nikka Giren Syuppan, 1971 and also to "STATISTIC ANALYSIS AND CONTROL OF DYNAMIC SYSTEM" by AKAIKE et al, SAIENSUSHA, 1972.

In case that combinations of variables ($x_1$, $y_i$) are obtained at moments i (i=1 . . . N), it is assumed that the relationship between the variables x and y is expressed by the following formula (1):

$$y=b_0 \exp(b_1 x) \tag{1}$$

the parameters $b_0$ and $b_1$ appearing in the formula can be determined in accordance with the following procedure.

The following formula (2) is obtained by linearizing logarithms of both sides of formula (1).

$$\log y=\log b_0+b_1 x \tag{2}$$

The values $x_i$ at the successive moments are substituted for formula (2) and differences between the obtained values and the values of corresponding fog $Y_i$ are defined as $\epsilon_i$.

$$\epsilon_i=\log b_0+b_1 x_i-\log Y_i \tag{3}$$

Then, the sum of the squares $\epsilon i^2$ of the difference $\epsilon_i$ obtained for the successive moments is defined as S.

$$S=\sum_{i=1}^{N} \epsilon_i^2=\sum_{i=1}^{N} (\log b_0+b_1 x_i-\log y_i)^2 \tag{4}$$

For the purpose of the present invention, the parameters $b_0$ and $b_1$ should be determined in such manner as to minimize the value of the sum S in the formula (4). This can be conducted by determining the values $b_0$ and $b_i$ which satisfy the following two formulae (5) and (6) which are obtained by equalizing the partial differentiations of the formula (4) by log $b_0$ and $b_1$ to zero.

$$N\log b_0+b_1 \sum_{i=1}^{N} x_i-\sum_{i=1}^{N} \log y_i=0 \tag{5}$$

$$b_1 \sum_{i=1}^{N} x_i^2+\log b_0 \sum_{i=1}^{N} x_i-\sum_{i=1}^{N} x_i \log y_i=0 \tag{6}$$

The simultaneous equations (5) and (6) can be solved and then the following formulae (7) and (8) are obtained.

$$b_0=\exp\left(\frac{\sum_{i=1}^{N} \log y_i \sum_{i=1}^{N} x_i^2-\sum_{i=1}^{N} x_i \sum_{i=1}^{N} x_i \log y_i}{N\sum_{i=1}^{N} x_i^2-\left(\sum_{i=1}^{N} x_i\right)^2}\right) \tag{7}$$

$$b_1=\frac{N\sum_{i=1}^{N} x_i \log y_i-\sum_{i=1}^{N} x_i \sum_{i=1}^{N} \log y_i}{N\sum_{i=1}^{N} x_i^2-\left(\sum_{i=1}^{N} x_i\right)^2} \tag{8}$$

When the values of parameters $b_0$ and $b_1$ are determined in accordance with the procedure explained above, if there is a close correlation between x and y due to their natures, the value of the sum S expressed by the formula (4) can be reduced to a sufficiently small value so that the assumption expressed by the formula (1) is validated. Since a close correlation exists between the temperature rising rate and the local maximum value of the thermal stress, as well as between the local maximum value of the thermal stress and the life consumption, the above-described procedure can be satisfactorily applicable for carrying out the present invention.

In order to theoretically support the validity of application of the above-described procedure in the boiler control system of the invention, a brief explanation will be made hereinunder as to the physical mechanism of the relationship between the temperature rising rate and the local maximum value of the thermal stress, as well as between the local maximum value of the thermal stress and the life consumption.

The thermal stress occurring in pressure parts of a boiler is critical particularly in regions where the thermal stress concentrates, e.g., a projection or the like on an inner surface of the pressure parts. It is well known that the thermal stress value in such regions can be evaluated by multiplying an inner surface thermal stress value with a stress concentration constant, which inner surface thermal stress is determined by assuming the pressure part is an infinite cylinder. A circumferential component of the inner surface thermal stress is usually large, which is given by the following formula, and this circumferential component is significant from the view point of management of the thermal stress at the thick portion.

$$\sigma_\theta=\frac{E\alpha}{1-\nu}\{T_{av}-T_i\} \tag{9}$$

Where, $\sigma\theta$ represents a circumferential thermal stress, E represents a Young's modulus, $\alpha$ represents a linear expansion coefficient, $\nu$ represents a Poison's ratio, $T_{av}$ represents a mean metal temperature of thick portion and $T_i$ represents a inner surface metal temperature of the thick portion.

The portion which exhibits the same temperature as the mean temperature $T_{av}$ exists within the thick portion. This suggests that the thermal stress as given by formula (9) depends on the metal temperature difference in a thickness direction of the thick portion.

The transition or propagation of heat in the thick-walled portion is ruled by heat conduction and basically represented by Fourier's equation. In order to simplify the explanation, an axisymmetry single-dimensional heat conduction is assumed and then the following equation is obtained.

$$\frac{\partial T}{\partial t}=\frac{k}{wc}\left[\frac{\partial^2 T}{\partial r^2}+\frac{1}{r}\frac{\partial T}{\partial r}\right]=\frac{k}{wc}\frac{1}{r}\frac{\partial}{\sigma r}\left(r\frac{\partial T}{\partial r}\right) \tag{10}$$

where, k represents a heat conductivity, c represents a specific heat, w represents a specific weight, r represents a radial distance and T represents a metal temperature.

The metal thick portion is sectioned into a plurality of concentric cylindrical layers and these layers are changed into concentration constants. The following formula (10) is obtained for the i-th cylindrical section as counted from the center of the cylinders.

$$\frac{dTi}{dt}= \tag{11}$$

-continued $$\frac{k}{wc}\cdot\frac{1}{r_i}\cdot\frac{1}{\Delta r}\left[r_{i+1}\frac{T_{i+1}-T_i}{\Delta r}-r_i\frac{T_i-T_{i-1}}{\Delta r}\right]$$

where, $\Delta r$ represents a thickness of the concentric cylindrical layer. The suffix i represents that the value is associated with the i-th section.

As a typical example, it is assumed here that a temperature equilibrium has been established in the metal thick portion and the temperature change is caused in the fluid flowing inside the thick portion. In this case, $T_{i+1}$ and $T_i$ are equal and the temperature change is occurred in the (i−1)th cylinder layer, and propagated radial outwards, so that the following formula (11) can be obtained.

$$\frac{wc\,(\Delta r)^2}{k}\cdot\frac{dT_i}{dt}=T_{i-1}-T_i \tag{12}$$

The formula (12) is a differential equation representing a first order log, and a time log constant $\tau_D$ thereof is represented by the following formula.

$$\tau_D=\frac{wc\,(\Delta r)^2}{k} \tag{13}$$

Formula (12) can be Laplace-transformed into the following formula (14).

$$T_i^*=\frac{T_{i-1}^*}{1+\tau_D S} \tag{14}$$

where, S represents a Laplacian indicative of time-differentiation, while the suffix * represents the Laplace transformed value.

In accordance with the formula (14), the temperature $T_N$ of the N-th section of the thick metal portion can be determined by the following formula, using the inner surface temperature $T_0$.

$$\begin{aligned}T_N^* &= \left(\frac{1}{1+\tau_D S}\right)\cdot\left(\frac{1}{1+\tau_D S}\right)T_{N-2}^* \\ &= \left(\frac{1}{1+\tau_D S}\right)^N T_0^*\end{aligned} \tag{15}$$

As explained before, the thermal stress occurring in thick metal portion is evaluated by the difference between the temperature at the inner surface and the temperature of the internal section of the thick metal portion, as will be also understood from formula (9).

Representing such temperature difference by $\Delta T$, the following relationship is derived from the formula (15).

$$\begin{aligned}\Delta T^* &= T_0^*-T_N^* \doteq \left\{1-\left(\frac{1}{1+\tau_D S}\right)^N\right\}T_0^* \\ &= \frac{1-\{1+{}_NC_1(\tau_D S)+\ldots+{}_NC_i(\tau_D S)^i+\ldots+(\tau_D S)^N\}}{(1+\tau_D S)^N}\,T_0^*\end{aligned} \tag{16}$$

The development expressed by the formula (16) follows binominal thereon.

The higher-degree terms of S of the numerator in the formula (16) provide higher-degree of differentiation of the inner surface temperature $T_0$. Obviously, the variation in the temperature $T_0$ is smooth, so that the higher degree differentiation coefficients, therefore, can be regarded as being zero (0) and then the second or more higher degree terms can be neglected. In consequence, the formula (16) can be simplified as follows.

$$\Delta T^*=\frac{1}{1+\tau_D S}\cdots\frac{1}{1+\tau_D S}\cdot(N\tau_D)\,ST_0^* \tag{17}$$

where, $$\frac{1}{1+\tau_D S}\cdots\frac{1}{1+\tau_D S}$$

represents a N-th order log, $N\tau_D$ represents a gain and $ST_D^*$ represents a rate of temperature change.

The formula (17) means that the radial temperature difference of the pressure parts, which rules the value of the thermal stress, has high order lags of the rate of change in the metal inner surface temperature. This proves that the asymptote of the radial temperature difference is proportional to the rate of change in the fluid temperature, i.e., the temperature rising rate mentioned before. This suggests that the local maximum thermal stress value can reasonably be treated in a certain relation to the temperature rising rate.

A method for evaluating the life of an apparatus in relation to the local maximum thermal stress has been proposed in the specification of Japanese Application No. 116201/1983 of the same applicant entitled "BOILER LOAD CONTROL APPARATUS". The detail of such an evaluation method, therefore, is not described in this specification, but it is to be noted that there is a close correlation between the local maximum thermal stress and the life, so that it is quite reasonable to consider the life consumption in a certain statistically-obtained relation to the local maximum thermal stress.

DESCRIPTION OF THE PREFERRED EMBODIMENTS

Figure 1:
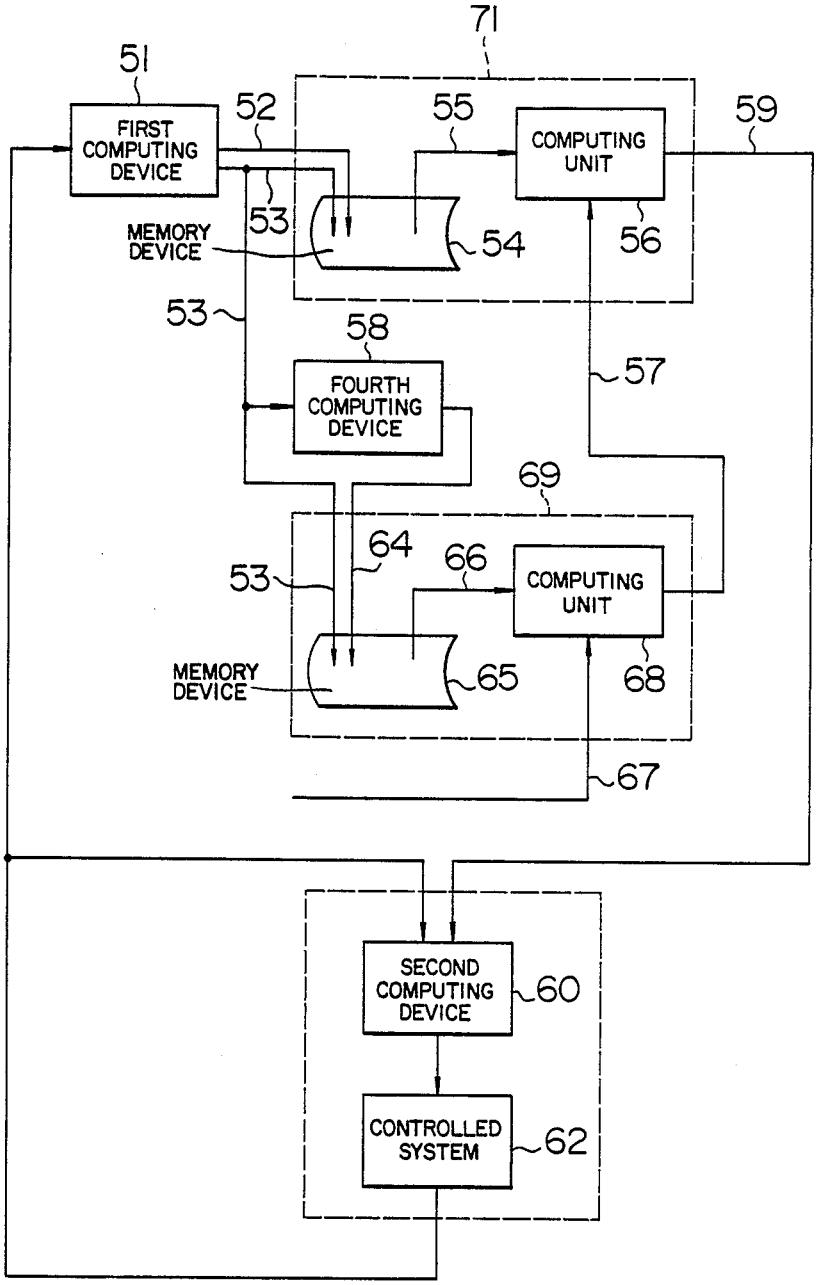
FIGS. 1, 2 and 3 are block diagrams of embodiments of a boiler control system in accordance with the present invention.
Figure 2:
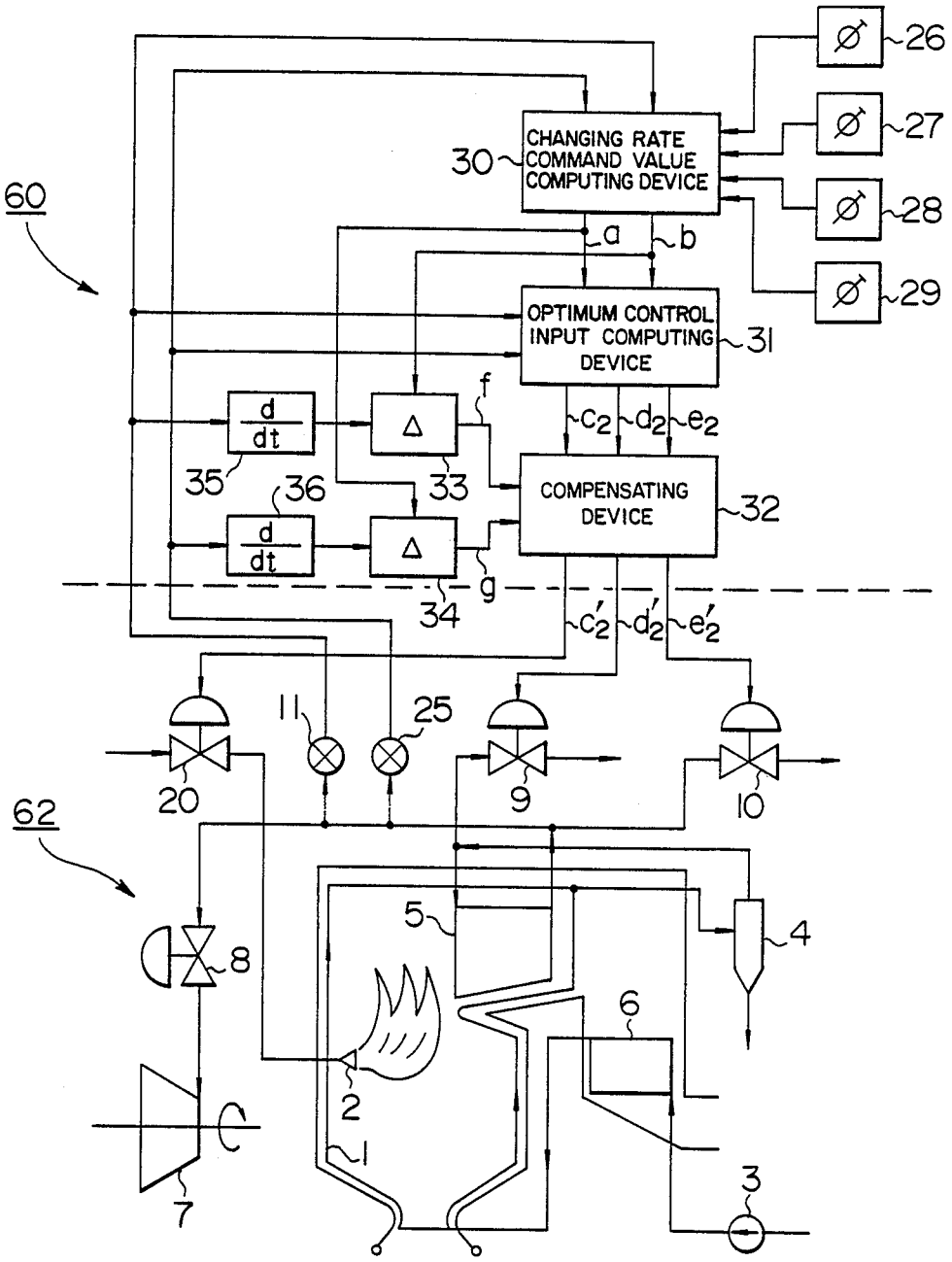

FIG. 1 shows an embodiment of the boiler control system in accordance with the present invention, which is applied to a boiler apparatus shown in FIG. 2.

In FIG. 2, the boiler apparatus has a water-tube wall 1 constituting a furnace wall, a burner 2, and a feedwater pump 3 for supplying feedwater to the water-tube wall 1. A reference numeral 4 denotes a steam-water separator by which a steam-water mixture is adapted to be separated into water and steam, which mixture is generated as a result of heating of the feedwater in the water-tube wall 1. The steam from the steam-water separator 4 is superheated by a superheater 5. The feedwater to be supplied to the water-tube wall 1 by the feedwater pump 3 is pre-heated by an economizer. The superheated steam is supplied to a turbine 7 to drive a generator (not shown) connected thereto.

A reference numeral 8; denotes a steam flow control valve disposed between the superheater 5 and the turbine 7 to control the flow rate of the steam which is supplied from the superheater 5 to the turbine 7.

The temperature of the steam from the steam-water separator 4 is low in the period immediately after the start-up of the boiler. If a large quantity of low-temperature steam is supplied to the superheater 5, the steam temperature at the superheater outlet is lowered to an unacceptable level. In order to avoid such an inconvenience, a superheater bypass valve 9 is provided for allowing the low-temperature steam to bypass the superheater 5 and to flow to a condenser or the like.

A reference numeral 10 denotes a turbine bypass valve which allows the steam from the superheater 5 to bypass the turbine 7 and to flow into the condenser or the like. The turbine bypass valve 10 is provided to relieve the steam when the steam flow control valve 8 is closed under the condition that the temperature and the pressure of the steam from the superheater 5 are still below the levels suitable for the supply to the turbine 7. The turbine bypass valve 10 is used, even after the supply of steam to the turbine 7, to relieve the steam when the flow rate of the steam is so small that the steam pressure control solely by the control of the fuel supply rate is ineffective.

A steam pressure detector 11 is provided for detecting the pressure of the steam supplied from the superheater 5 to the turbine 7. A reference numeral 20 denotes a fuel flow control valve for controlling the flow rate of the fuel supplied to the burner 2. A steam temperature detector 25 is provided for detecting the temperature of the steam from the superheater 5. A command pressure setting device 26 is intended for setting a command steam pressure $P_1$ (shown in FIG. 4D) to which the steam temperature is to be increased. A command steam temperature setting device 27 is provided for setting the command temperature to which the steam temperature is to be increased at the outlet of the superheater 5 when the temperature rise is completed. A reference numeral 28 designates a saturation temperature changing rate limit setter for setting a limit value of the rate of change in the saturation temperature for suppressing the thermal stress occurring in the thick portion of the steam-water separator 4. A temperature rising rate limit setter 29 is provided for setting a limit value of the temperature rising rate for the purpose of suppressing the thermal stress in a thick portion of an outlet header of the superheater 5. A reference numeral 30 designates a changing rate command value computing device which receives detection output value signals from the steam pressure detector 11 and the steam temperature detector 25, as well as set value signals from the setting devices 26, 27, 28 and 29. The device 30 conducts a predetermined computation in accordance with these signals so as to determine and output a temperature rise command signal a and a pressure rising rate command signal b. A reference numeral 31 designates an optimum control input computing device which conducts a predetermined computation in accordance with the detected value signals from the steam pressure detector 11 and the steam temperature detector 25 and also with the temperature rising rate command signal a and the pressure rising rate command signal b from the changing rate command value computing device 30, and outputs command signals such as a fuel flow control valve opening command signal $c_2$, a superheater bypass valve opening command signal $d_2$ and a turbine bypass valve opening command signal $e_2$.

A reference numeral 32 designates a compensating device which compensates or corrects, through predetermined computation and control, the opening command signal $c_2$, $d_2$ and $e_2$ from the optimum control input computing device 31, in accordance with error signals f and g, thereby outputting corrected opening command signals $c_2'$, $d_2'$ and $e_2'$.

The boiler control system further has a differentiation device 35 which receives and differentiates the value detected by the steam pressure detector 11 to compute the actual pressure rising rate signal, and a comparator 33 which compares the pressure rising rate signal computed by the differentiator 35 with the pressure rising rate command signal a to output a pressure rising rate error signal f. Another differentiation device 36 is provided for receiving and differentiating the detected steam temperature value from the steam temperature detector 25 so as to determine the actual temperature rising rate. The thus computed temperature rising rate signal is compared by another comparator 34 with the temperature rising rate command signal b, whereby a temperature rising rate error signal g is output therefrom.

A reference numeral 32 designates a compensating device which compensates or corrects, through predetermined computation and control, the opening command signals $c_2$, $d_2$ and $e_2$ from the optimum control input computing device 31, in accordance with error signals f and g, thereby outputting corrected opening command signals $c_2'$, $d_2'$ and $e_2'$.

Referring back to FIG. 1, the boiler control system in accordance with the present invention has a first means 51 which receives the above-mentioned measured signals indicative of, for example, the steam temperature and the pressure in controlled system 62 and computes experience values 52, 53 of the steam temperature changing rate and the local maximum thermal stress at the thick portion of the apparatus. The boiler system further has a fourth means 58 which computes, upon receipt of the thermal stress value signal 53, an experience value of life consumption 64 after completion of each heating cycle of the apparatus. A reference numeral 65 denotes a memory device for storing the data 53 and 64, while 68 denotes a local maximum thermal stress limit computing unit which computes, upon receipt of a life consumption command 67 gived for the start-up of the apparatus, a limit value 57 of the local maximum thermal stress corresponding to the life consumption command 67, with reference to the data 66 stored in the memory device 65. The memory device 65 and the computing unit 68 in combination constitute a fifth means 69. The boiler control system also has a memory device 54 for storing data 52 and 53, and a temperature rising rate limit computing unit 56 which computes, upon receipt of the local maximum thermal stress limit value 57, a temperature rising rate limit value 59 corresponding to the local maximum thermal stress limit value 57, with reference to data 52 and 53 stored in the memory device 54. The memory device 54 and the computing unit 56 in combination constitute a third means 71.

The boiler control system further has a second means 60 which computes control commands for controlling the controlled system 62, for example the values 9, 10 and so on, in accordance with the temperature rising rate limit valve 59 from the unit 56 and the measured signals from the controlled system 62.

The detailed arrangements of the second means 60 and the controlled system 62 is disclosed in FIG. 2. These arrangements are described in Japanese Patent Application No. 145932/1984 entitled "BOILER START-UP CONTROL SYSTEM".

The function of the first means 61 is to compute, upon receipt of signals representing measured values in the controlled system 62 and in accordance with the condition of the intermal fluid in the pressure parts, the temperature distribution in the metal pressure parts, as well as thermal stress components in the axial, the radial and the tangential directions. The fourth means 58 conducts a like consumption calculation as follows.

During one heat cycle, in accordance with amplitudes of changes (the differences between the positive local maximum and the negative local maximum) of the differences (the principal stress differences) of three components computed by the first means 51, a life consumption due to fatigue in the pressure parts is calculated in the fourth means 58 further, the fourth means 58 calculates a life consumption due to creep in the pressure parts in accordance with the local maximum in accordance with the local maximum of the root of sum of squares of the three components ( which corresponds to the stress) and the time lapse after the heat cycle. A life consumption in the pressure parts during one heat cycle is calculated by adding the above-mentioned life consumption due to fatigue and the above-mentioned life consumption due to creep.

The one heat cycle is between a moment at which the temperature of the fluid in the pressure parts changes from a certain level (usually at shut-down state of the apparatus) and a moment at which such temperature returns lack to the above certain level. Such one heat cycle usually begins at starting-up of the apparatus and ends at shut-down thereof through a duty operation.

The functions of the first means 51 and the fourth means 58 are described in detail in Japanese Patent Application Nos. 223939/1982 and 116201/1983, as well as in "BOILER THERMAL STRESS MONITORING SYSTEM", Hitachi Hyoron, Vol. 65, No. 6, p. 391.

The third means 71 and the fifth means 69 determine, in accordance with the formulae (7) and (8) and using data stored in the memory devices 54 and 65, the parameters $b_0$ and $b_1$ of the formula (1). In the described embodiment, the value x is unknown and is determined by substituting a known value for y in formula (1). The thus obtained parameters $b_0$ and $b_1$ are input as $B_{30}$ and $b_{31}$, respectively, to the third means. Similarly, the parameters $b_0$ and $b_1$ are delivered to the fifth means as $b_{50}$ and $b_{51}$ to the fifth means. Using these values of parameters, the third and the fifth means execute the following operations.

(Fith Means)

$$(\text{signal } 57) = \frac{1}{b_{51}} \log\left(\frac{(\text{signal } 67)}{b_{50}}\right) \tag{18}$$

-continued (Third Means)

$$(\text{signal } 59) = \frac{1}{b_{31}} \log\left(\frac{(\text{signal } 57)}{b_{30}}\right) \tag{19}$$

The second means 60 receives the temperature rising rate limit value 59 as computed by the third means 71. The signal representing this value should be obtained for each of the parts which are subjected to the life administration. In the described embodiment, these parts are the outlet header of the superheater 5 and the steam-water separator 4. The fluid in the steam-water separator 4 is a saturated mixture of steam and water and then the temperature of the fluid is the saturation temperature which is linearly determined by the pressure. Accordingly, from the view points of accuracy of measurement and easiness of control, the pressure is used preferably as the control parameter rather than the temperature. This is the reason why the life consumption administration for the steam-water separator 4 is conducted in terms of pressure rising rate limit value.

The operation of the second means 60 is described in detail in U.S. Pat. No.4,637,348. Briefly, the second means 60 computes the control inputs (optimum control inputs), e.g., for the opening degrees of valves, in accordance with the present state of the plant, in such a manner as to minimize the start-up time without causing the temperature and pressure rising rates to exceed the limit values given by the signal 59, while meeting the requirement of minimized fuel consumption. The second means 60 then executes the control of the start-up using the thus obtained control inputs.

In order to attain a higher accuracy of computation of the optimum control inputs performed by the second means 60, it is possible to use a system disclosed in Japanese Patent Application No. 282042/1985 of the same inventors. The system proposed in Application No. 282042/1985 is materially the same as that proposed in U.S. Pat. No. 4,637,348 mentioned before, except for the features concerning parameter adaptive functions.

Figure 3:
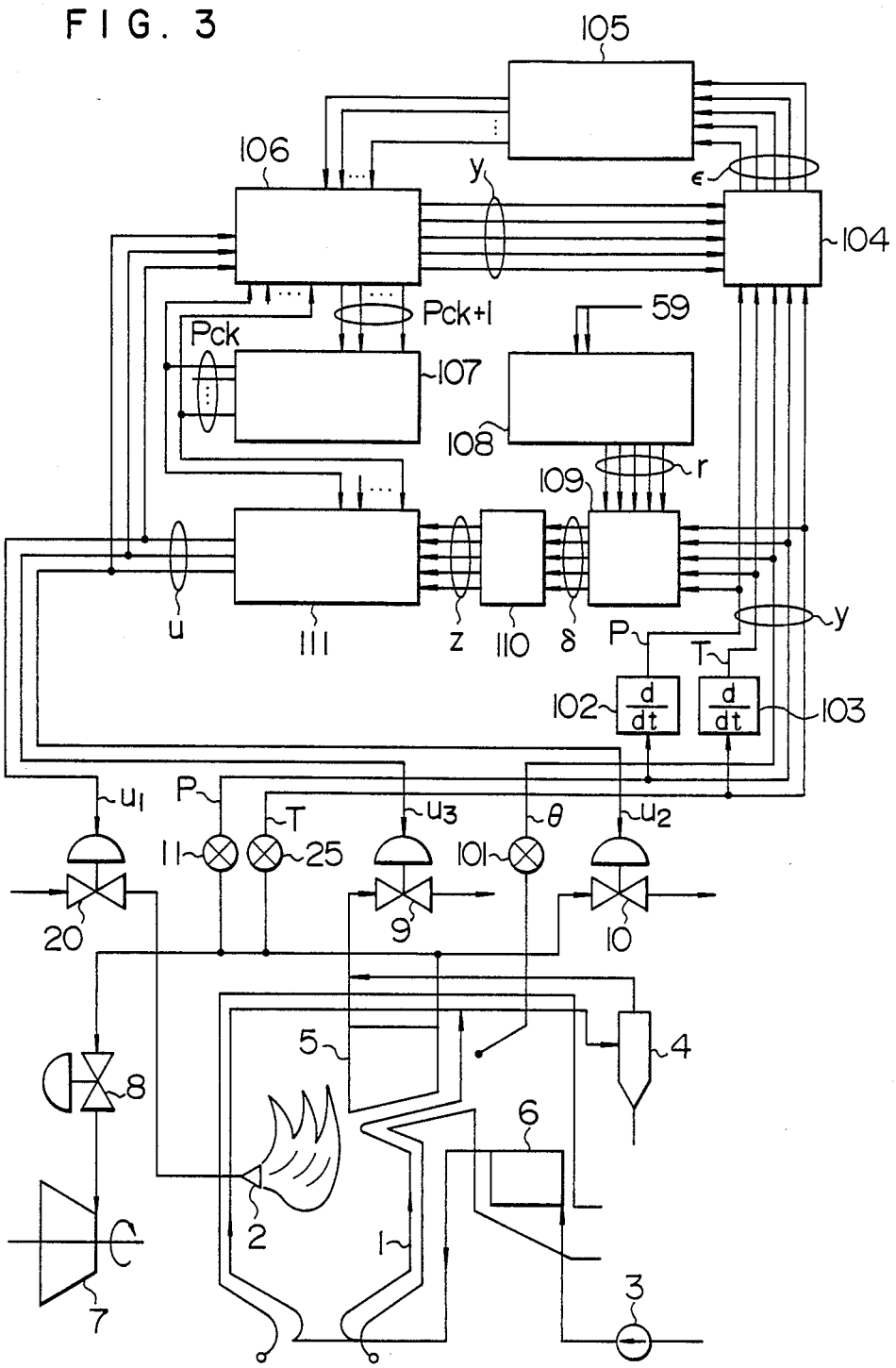

In another embodiment of the present invention shown in FIG. 3, the second means is substituted by a system proposed in Japanese Patent Application No. 076801/1986 of the same inventors. The construction of the second means in this embodiment is shown in FIG. 3. The operation of the second means in this embodiment is not described here because a detailed description is made in Japanese Patent Application No. 076801/1986. It is to be noted, however, that this embodiment employing the second means shown in FIG. 3 enables the application of Kalman filter and optimum regulator theory, which in turn ensures operation of the plant under optimum operating conditions by minimizing the performance function which can be replacable in accordance with the purpose.

Figure 4:
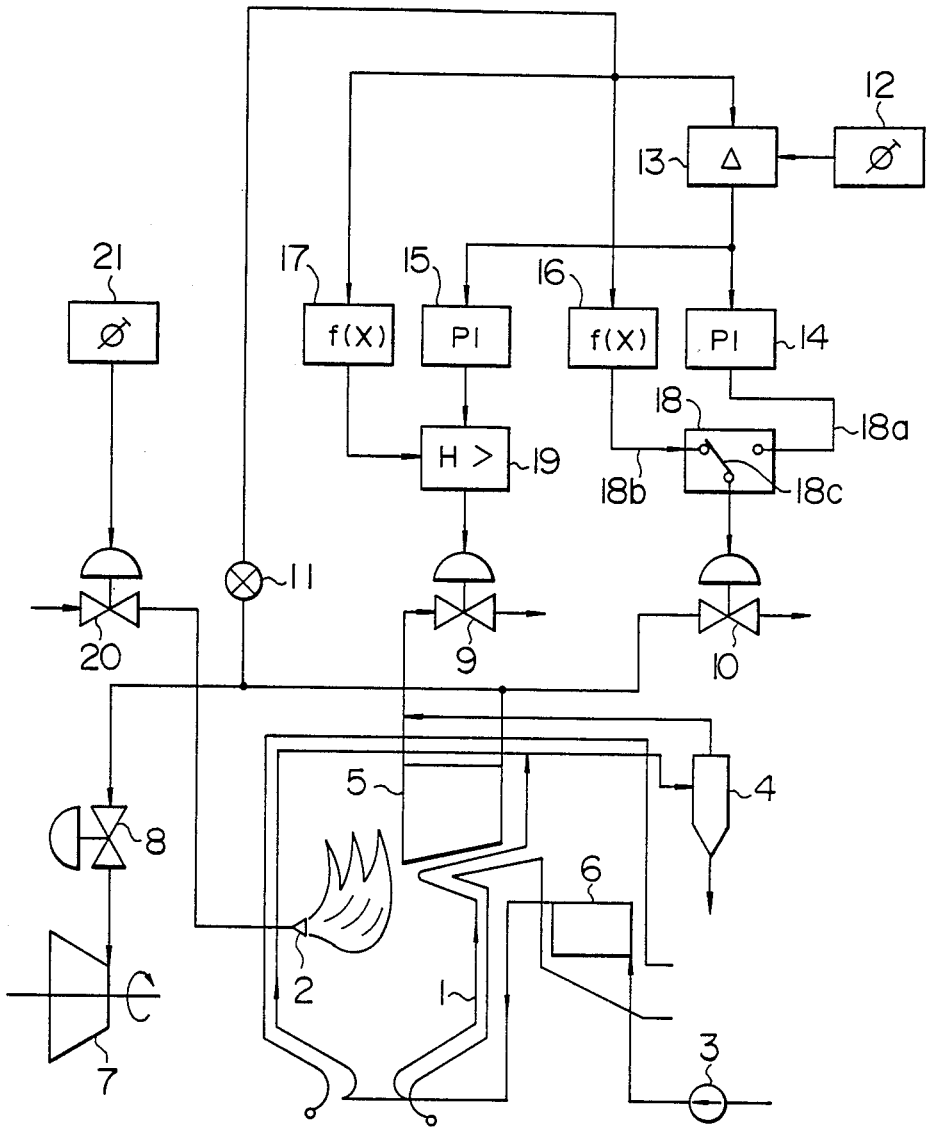
FIGS. 4 and 6 are block diagrams of known boiler control systems.
Figure 5A:
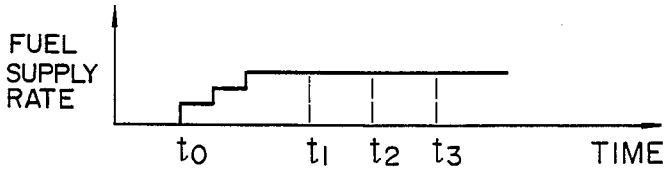
FIG. 5 is a timing chart showing the operation of a known boiler control system.
Figure 5B:
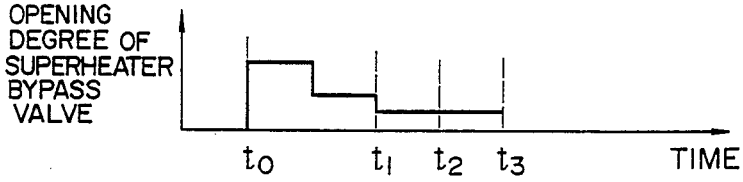
Figure 5C:
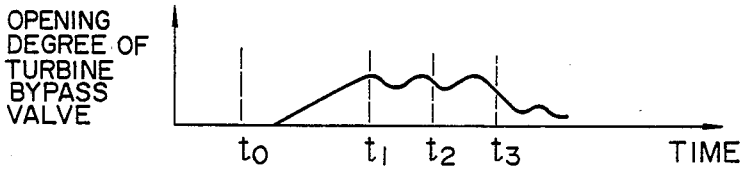
Figure 5D:
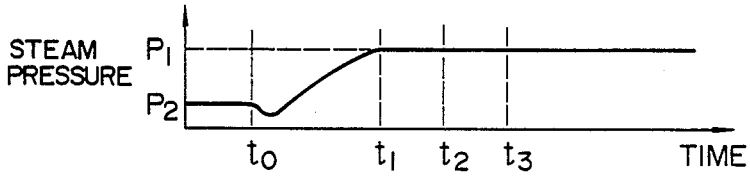
Figure 5E:
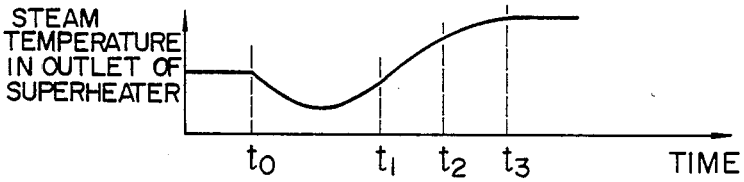
Figure 6:
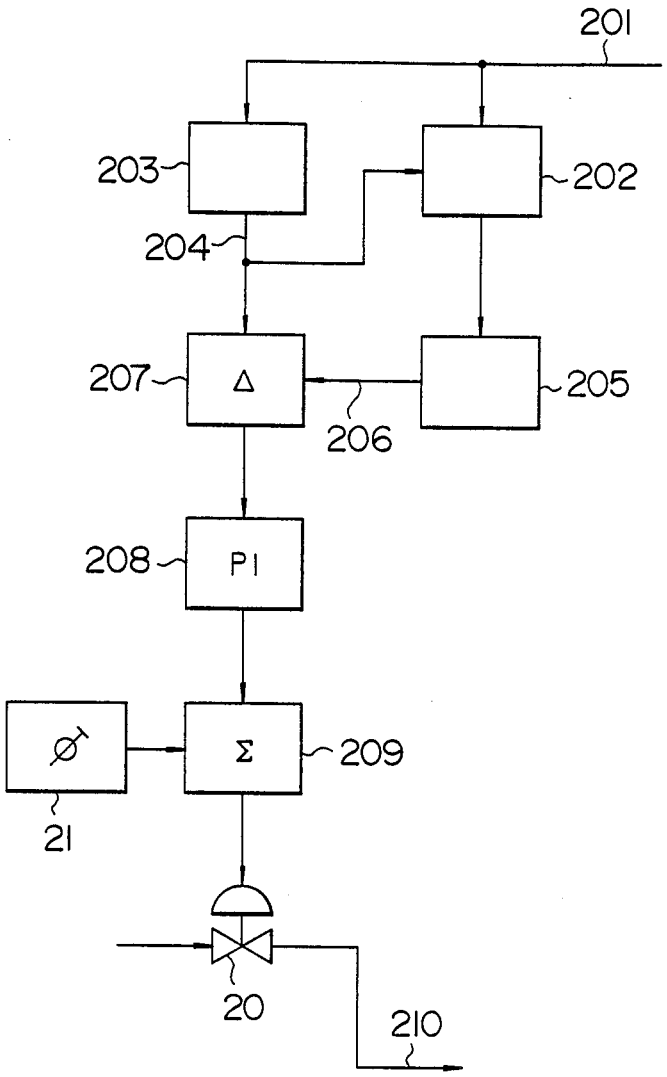

Now, the operation of the prior boiler control system shown in FIG. 4 will be explained with time charts shown in FIGS. 5A to 5E, as compared with the present invention. FIG. 5A shows a change in the fuel supply rate in relation to time, FIG. 5B shows a change in the opening degree of the superheater bypass valve 9 in relation to time, and FIG. 5C shows a change in the opening degree of the turbine bypass valve 10 in relation to time. FIG. 5D and 5E show, respectively, changes in the steam pressure and the superheater outlet steam temperature in relation to time.

A firing is set on the boiler apparatus at a moment $t_0$. The rise of the steam pressure and the rise of the steam temperature are completed at moments $t_1$ and $t_2$, respectively. Steaming to the turbine 7 is commenced at a moment $t_3$. Symbols $p_2$ and $p_1$ represent, respectively, the initial steam pressure and the command steam pressure.

After the firing on the boiler apparatus at the moment $t_0$, the number of burners in operation is increased step by step and, in accordance with the increase in the number of the operating burners, the opening degree setting device 21 produces an opening command signal by which the opening degree of the fuel flow rate control valve 20 is increased so that the fuel flow rate is increased step by step as shown in FIG. 5A. Before the steam pressure reaches the command pressure $p_1$, a contactor 18*c* of a signal switching device 18 is kept in contact with a terminal 18*b*. Therefore, an opening degree of a turbine bypass valve 10 is controlled in accordance with the output from a function generator 16, which is responsive of the steam pressure detected by the steam pressure detector 11, until the detected steam pressure reaches the command pressure $p_1$. In consequence, the opening degree of the turbine control valve 10 is controlled in accordance with the steam pressure. The function generator 16 is set beforehand in such a manner as to enable the steam pressure to rise up to the command pressure $p_1$ at a suitable rate of pressure rise. When the steam pressure reaches the command steam pressure $p_1$ at the moment $t_1$, the contactor 18*c* of the signal switching device 18 is switched into contact with the terminal 18*a* so that the opening degree of the turbine bypass valve 10 is controlled in accordance with an output of a proportional and integral device 14 in such a manner as to relieve the steam, as shown in FIG. 5C. The saturation temperature of the steam is low in the period in which the steam pressure is low. In such a period, therefore, the temperature of the steam supplied from the steam-water separator 4 to the superheater 5 is low. The function generator 16 therefore delivers a command signal for increasing the opening degree of the superheater bypass valve 9 so as to relieve steam of the low temperature, whereby the flow rate of the steam flowing through the superheater 5 is decreased to cause a rise in the steam temperature at the outlet of the superheater 5.

Once the steam pressure reacheds the command steam pressure $p_1$, the opening degree of the turbine bypass valve 10 is controlled in accordance with the signal which is obtained through proportional and integral of a pressure error between the command pressure $p_1$ set in the pressure setting device 12 and the actual steam pressure detected by the steam pressure detector 11, as shown in FIG. 5C. After the moment $t_1$ at which the pressure rise of the steam is finished, when the rate of rise of the steam pressure has become so large that excessive rise in the steam pressure beyond the command pressure cannot be avoided even by full-opening of the turbine bypass valve 10, the level of the output signal from the proportional and integral device 15 becomes so high as to be selected by the high-signal selector 19. In consequence, the opening degree of the superheater bypass valve 9 is increased so as to relieve the steam thereby preventing excessive rise of the steam pressure. A reference numeral 201 designates a thermal stress monitoring device.

As will be understood from the foregoing description, the present invention offers the following advantages as compared with the prior art.

(1) It is possible to obtain the temperature rising rate and the pressure rising rate by which the thermal stresses in thick portions can be prevented from exceeding limit values.

(2) The system of the invention, when combined with one of the start-up control systems, makes it possible to attain the quickest start-up which can cause no problem in the thermal stress. (3)

It is possible to grasp, in accordance with the state of the plant, the allowable value of the thermal stress which is necessary for the purpose of conducting the start-up without causing life consumption to exceed any given allowed limit in the thick portion in the plant.

(4) It can be possible to realize the quickest start-up without causing life consumption to exceed any given allowed limit in the thick portion in the plant by combining the features (1), (2) and (3). Thus, it can be possible to conduct a most economical operation in respect of the life consumption control.

(5) The quickest start-up as mentioned in (4) above can be conducted in such a way as to minimize the rate of fuel supply. Thus, it can be possible to conduct a most economical operation in respect of the operation cost.

What is claimed is:

1. A boiler control system for a boiler apparatus including:

first means for obtaining a rate of change in steam temperature and a generated thermal stress in a pressure part of a boiler;

second means for controlling a steam temperature or a rate of change in the steam temperature at said part of said boiler in accordance with a desired value; and third which comprises:

storage means for storing combinations of said steam temperature and said thermal stress at each moment as obtained by said first means;

means for determining, from said combinations stored in said storage means, a relationship between a steam temperature changing rate and a local maximum thermal stress;

means for determining, in accordance with said relationship, a steam temperature changing rate limit value necessary for maintaining an actual thermal stress in said part of said boiler below a local maximum thermal stress limit value which is predetermined beforehand or which is given for each start-up of said boiler; and means for delivering said steam temperature changing rate limit value or a desired steam temperature value obtained by intergranting said steam temperature changing rate limit value to said second means as said desired value.

2. A boiler control method for a boiler apparatus including the following steps of:

storing in storage means combinations of a steam temperature and a thermal stress generated in a pressure part of a boiler at each moment;

determining a relationship between a steam temperature changing rate and a local maximum thermal stress by using a statistical analysis of said combinations stored in said storage means;

determining, in accordance with said relationship, a steam temperature changing rate limit value necessary for maintaining an actual thermal stress in said part of said boiler below a local maximum thermal stress limit value which is predetermined in advance or which is given for each start-up of said boiler; and controlling a steam temperature or a steam temperature changing rate in accordance with said steam temperature changing rate limit value or a desired command steam temperature value obtained by integrating said steam temperature changing rate limit value as desired value.

3. A boiler control method for a boiler apparatus including the following steps of:

storing in storage means combinations of a steam temperature and a thermal stress generated in a pressure part of a boiler at each moment;

determining a relationship between a steam temperature changing rate and a local maximum thermal stress by modeling;

determining, in accordance with said relationship, a steam temperature changing rate limit value necessary for maintaining an actual thermal stress in said part of said boiler below a local maximum thermal stress limit value which is predetermined in advance or which is given for each start-up of said boiler; and controlling a steam temperature or a steam temperature changing rate in accordance with said steam temperature changing rate limit value or a desired command steam temperature value obtained by integrating said steam temperature changing rate limit value as desired value.

* * * * *